US007854586B2

(12) United States Patent
Major et al.

(10) Patent No.: US 7,854,586 B2
(45) Date of Patent: Dec. 21, 2010

(54) INLET GUIDE VANE INNER AIR SEAL SURGE RETAINING MECHANISM

(75) Inventors: Daniel W. Major, Middletown, CT (US); Edward Torres, Newington, CT (US)

(73) Assignee: United Technologies Corporation, Hartford, CT (US)

( * ) Notice: Subject to any disclaimer, the term of this patent is extended or adjusted under 35 U.S.C. 154(b) by 873 days.

(21) Appl. No.: 11/809,150

(22) Filed: May 31, 2007

(65) Prior Publication Data

US 2008/0298955 A1 Dec. 4, 2008

(51) Int. Cl.
*F01D 5/03* (2006.01)
*F01D 11/00* (2006.01)

(52) U.S. Cl. ..... 415/160; 415/170.1

(58) Field of Classification Search ..... 415/170.1, 415/173.1, 173.7, 160, 148, 150, 151, 159, 415/161, 162, 230
See application file for complete search history.

(56) References Cited

U.S. PATENT DOCUMENTS 3,079,128 A * 2/1963 Burge ..... 415/191
5,088,279 A 2/1992 MacGee
5,211,533 A 5/1993 Walker et al.
5,289,677 A 3/1994 Jarrell
5,328,327 A 7/1994 Naudet
5,636,968 A 6/1997 Audet et al.
5,785,492 A 7/1998 Belsom et al.
5,796,199 A * 8/1998 Charbonnel ..... 310/90
6,270,037 B1 8/2001 Freese et al.
6,413,043 B1 7/2002 Bouyer
7,121,727 B2 10/2006 Bruce et al.
7,131,815 B2 11/2006 Allford et al.
7,458,771 B2 * 12/2008 Abadie et al. ..... 415/160
2005/0084190 A1 4/2005 Brooks et al.

FOREIGN PATENT DOCUMENTS

EP 1626163 2/2006

* cited by examiner

*Primary Examiner*—Edward Look
*Assistant Examiner*—Dwayne J White
(74) *Attorney, Agent, or Firm*—Kinney & Lange, P.A.

(57) ABSTRACT

An inner air seal carrier for use in a gas turbine engine having an inlet guide vane surge retainer comprises a body, a stationary sealing element and an outcropping. The body secures around an inlet guide vane inner diameter shroud. The stationary sealing element is disposed on a radially inward face of the body for engaging with a rotatable sealing element of a compressor rotor. The outcropping is positioned on the radially inward face of the body forward of the stationary sealing element for engaging with the surge retainer.

22 Claims, 3 Drawing Sheets

INLET GUIDE VANE INNER AIR SEAL SURGE RETAINING MECHANISM

BACKGROUND

In low-bypass ratio turbofan engines, a fan is used to produce thrust in two manners. First, the fan pushes primary air into the core of the gas turbine engine for supplying air to a combustion process used to push gas through an exhaust nozzle. Second, the fan pushes bypass air past the core of the gas turbine engine to directly produce thrust. The fan is typically located at the inlet of the gas turbine engine within a fan case. The fan case is connected to an intermediate case that includes ducting for dividing the output of the fan into primary and bypass airstreams. The bypass air is routed around to the rear of the gas turbine engine, while the primary air is routed from the low pressure fan into the high pressure compressor (HPC) of the gas turbine core. The HPC comprises a series of rotating blades and stationary vanes for incrementally increasing the pressure of the primary air. These blades and vanes, starting with the first-stage blades, are sequentially housed within a high pressure compressor (HPC) case aft duct, which is connected to the immediate downstream face of the intermediate case. Thus, the first-stage blades receive air routed from the intermediate case. In order to optimize the incidence of the primary air onto the first-stage blades, a set of inlet guide vanes (IGVs) is provided between the intermediate case and the HPC case aft duct. The outer diameter ends of IGVs include trunnions that are inserted into bores in the HPC case aft duct. The inner diameter ends of the IGVs include trunnions that are inserted into an inner diameter shroud. In order to prevent the inner diameter of the IGVs from moving during operation of the gas turbine engine, especially during a surge event, the inner diameter shroud is pinned to the intermediate case with a surge retainer. In order to increase engine efficiency, it is desirable to seal the airflow path between the IGVs and the first-stage blades, while simultaneously minimizing the cavity space between the IGVs and the first-stage blades. Thus, there is a need for an IGV inner diameter retention and sealing mechanism that reduces the cavity between the IGVs and the first blade.

SUMMARY

The present invention is directed toward an inner air seal carrier for use in a gas turbine engine having an inlet guide vane surge retainer. The inner air seal carrier comprises a body, a stationary sealing element and an outcropping. The machined body, which can be roll-formed or machined, secures around an inlet guide vane inner diameter shroud. The stationary sealing element is disposed on a radially inward face of the body for engaging with a rotatable sealing element of a compressor rotor. The outcropping is positioned on the radially inward face of the body forward of the stationary sealing element for engaging with the surge retainer.

DETAILED DESCRIPTION

Figure 1:
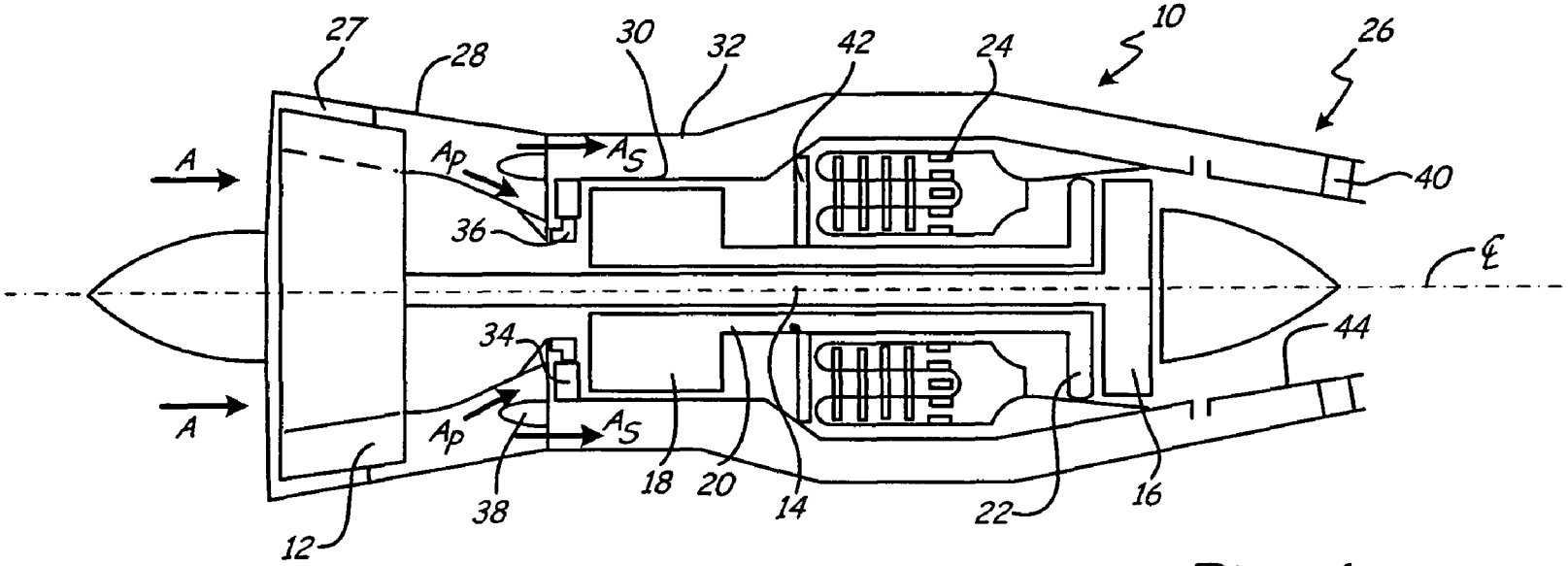
FIG. 1 shows a schematic diagram of a low-bypass ratio turbofan engine in which the inlet guide vane inner air seal surge retention system of the present invention may be used.

FIG. 1 shows a schematic diagram of a dual-spool, low-bypass ratio turbofan engine 10, in which the advantages of the inlet guide vane inner air seal surge retention system of the present invention is particularly well illustrated. Although, in other embodiments the present invention is applicable to other types of gas turbine engines such as high-bypass ratio turbofans including geared turbofans. Engine 10 comprises a low pressure spool, comprising low pressure fan 12, low pressure shaft 14 and low pressure turbine (LPT) 16; and a high-pressure spool, comprising high pressure compressor (HPC) 18, high pressure shaft 20 and high pressure turbine (HPT) 22. Engine 10 also includes combustor 24, which is nested between HPC 18 and HPT 22, and exhaust section 26, which is used to accelerate exiting gases to produce thrust. The low pressure spool and the high pressure spool are each concentrically disposed around longitudinal engine centerline CL. Low pressure fan 12 includes one or more fan blade stages and, in various embodiments, includes a low pressure compressor section. Low pressure fan 12 is encased in fan case 27 and intermediate case 28, which is connected with HPC case aft duct 30 and bypass duct 32 such that split flow-paths are each concentrically disposed around longitudinal engine centerline CL. Aft duct 30 typically comprises split upper and lower portions such that it is easily assembled around low pressure shaft 14. Rotatable inlet guide vanes (IGVs) 34 are disposed between intermediate case 28 and HPC 18 to moderate airflows within engine 10 for improving engine performance. Inlet guide vanes 34 are secured at their inner diameters to intermediate case 28 with inner air seal surge retaining mechanism 36 of the present invention.

Inlet air A enters engine 10 and it is divided into streams of primary air $A_P$ and secondary air $A_S$ by flow divider 38 after it passes through fan 12. Low pressure fan 12 is rotated by low pressure turbine 16 through shaft 14 to accelerate secondary air $A_S$ (also known as bypass air) into bypass duct 32 and through exit guide vanes 40 within exhaust section 26, thereby producing a portion of the thrust output of engine 10. Primary air $A_P$ (also known as gas path air) is also directed first into low pressure fan 12 and then routed to inlet guide vanes 34 in front of high pressure compressor (HPC) 18 by divider 38. HPC 18 is rotated by HPT 22 through shaft 20. Low pressure fan 12 and HPC 18 work together to incrementally step up the pressure of primary air $A_P$ to provide compressed air to combustor section 24. The compressed air is delivered to combustor section 24, along with fuel through injectors 42, such that a combustion process can be carried out to produce the high energy gases necessary to turn turbines 22 and 16. Primary air $A_P$ continues through gas turbine engine 10 whereby it is passed through exhaust nozzle 44 to produce thrust.

In order to improve the performance of engine 10, it is desirable to increase the compression of primary air $A_P$ and secondary air $A_S$ as they flow through low pressure fan 12 and HPC 18. Accordingly, engine 10 is provided with inlet guide vane 34 that redirects entering primary air $A_P$ to optimize its incidence on the first stage blades within HPC 18. The IGV also modulates the airflow through the HPC, thus reducing the occurrence of compressor surges. Compressor surges occur when an excessive increase in axial air pressure along the flow path causes flow instability or reversal within the HPC. Particularly, an axial air pressure increase causes the laminar gas-flow at the blades and vanes to become turbulent. The turbulent flow separates from the blades and vanes, detrimentally impacting compressor efficiency and causing high-pressure gases downstream to lurch or "surge" forward.

Surges may fatigue various engine components such as the IGV. Engine performance is further enhanced by sealing the flow path, which volumetrically reduces the flow path cavity to increase compression efficiency. In order to seal the flow path around primary air $A_P$, and to stabilize inlet guide vanes 34, inlet guide vanes 34 are provided with inner air seal surge retaining mechanism 36.

Figure 2:
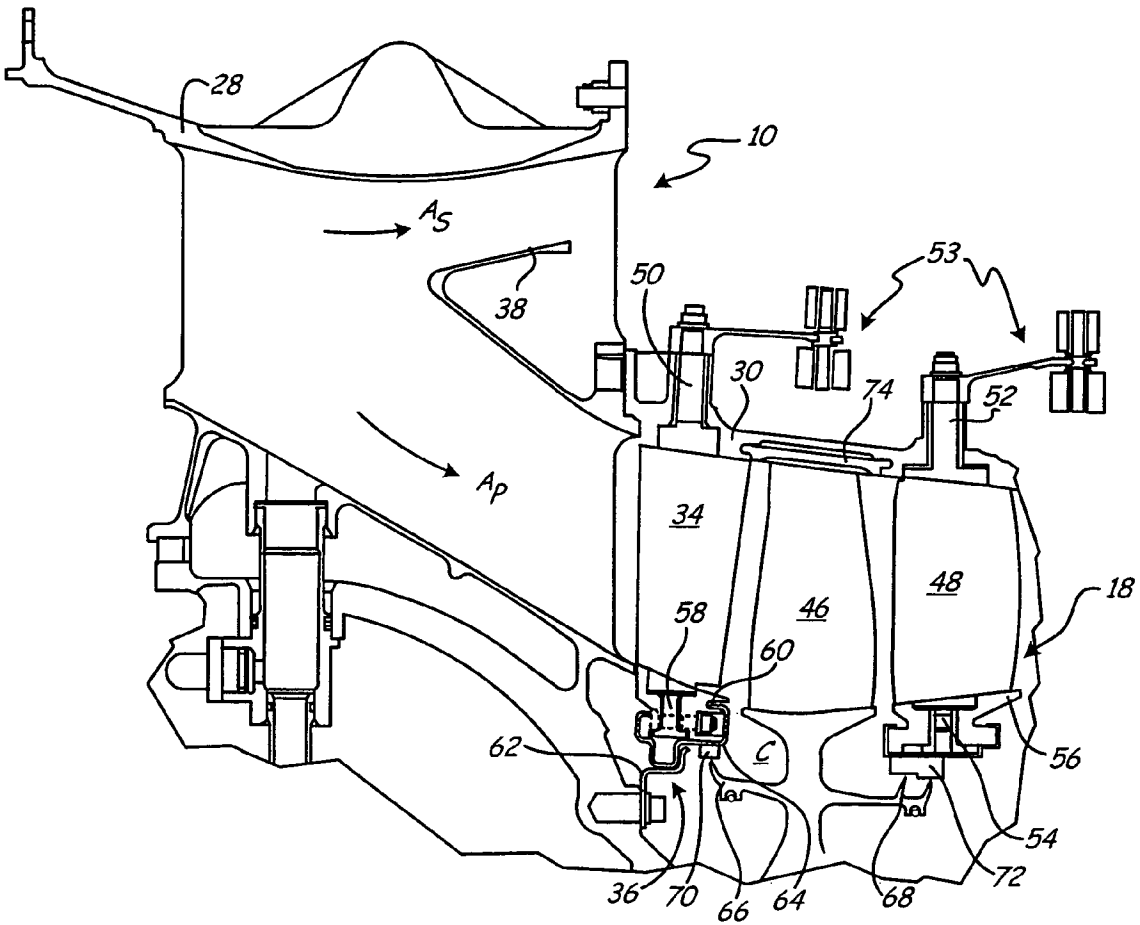
FIG. 2 shows a partial section view of the turbofan engine of FIG. 1 in which the transition between an intermediate duct and a high pressure compressor case is shown.

FIG. 2 shows inner air seal surge retaining mechanism 36 positioned between intermediate duct 28 and HPC case aft duct 30 of engine 10. Primary air $A_P$ is directed from within intermediate duct 28 to HPC 18 by divider 38, while secondary air $A_S$ is routed outside of HPC aft duct 30, past HPC 18. HPC 18 includes an array of first-stage blades and vanes, including first-stage blade 46 and first-stage vane 48, that extend radially from engine centerline CL. First-stage blade 46 of HPC 18 rotates as it is driven by shaft 20 and HPT 22 to drive air past first-stage vane 48 to increase the pressure of primary air $A_P$. IGV 34 and first-stage vane 48 are adjustable to control the flow incidence to first-stage blade 46.

The outer diameter ends of IGV 34 and first-stage vane 48 include trunnions 50 and 52, respectively, which are secured within bores in aft duct 30. Trunnions 50 and 52 are connected to actuation mechanisms, such as a bell crank 53, so that the pitch of the vanes can be adjusted to alter the airflow of primary air $A_P$. The inner diameter end of first-stage vane 48 includes trunnion 54, which is configured for rotation within split-ring inner diameter shroud 56. Likewise, IGV 34 includes inner diameter trunnion 58, which is configured for rotation in split-ring inner diameter shroud 60.

Split-ring inner diameter shroud 60 and inner diameter shroud 56 stabilize the inner diameter ends of IGV 34 and vane 48, respectively. Shrouds 60 and 56 also enable synchronized rotation of IGV 34 and vane 48 on trunnions 54 and 58, respectively, by fixing the circumferential spacing of the vanes. Thus, inlet guide vane 34 and first-stage vane 48 are suspended from aft duct 30 such that they are cantilevered within the airflow of primary air $A_P$. Typically, for compressor vanes no other inner diameter support is necessary. Compressor vanes, including first-stage vane 48, are generally comprised of a high-strength material such as nickel and have a generally sturdy construction such that the combined radial strength, as provided by inner diameter shroud 56, typically provides enough resistance to the bending stresses sustained during operation of engine 10. Additionally, compressor vanes are generally short such that the bending stress imparted to them is small. However, for IGV 34, which is generally longer than a compressor vane, additional inner diameter retention and support is typically required.

Inlet guide vane 34 is typically comprised of titanium rather than nickel since it is not subjected to as high of temperatures as vane 48 or other compressor vanes. Titanium is relatively less strong than nickel and is therefore more susceptible to bending stress. Furthermore, IGV 34 is subjected to oscillations due to the operation of engine 10 and, in particular, to surge events. Typically during operation of engine 10, pressure builds up within HPC 18 such that IGV 34 is normally pushed forward within engine 10. During surge events, however, flow direction within HPC 18 can instantaneously change and IGV 34 will bend back toward first-stage blade 46, potentially resulting in contact with first-stage blade 46. Thus, vane-angle of IGV 34 and first-stage vane 48 is actuated to control pressure within HPC 18 to alleviate surge conditions. Therefore, in addition to potentially large bending during surge events, IGV 34 is subjected to low-frequency bending cycles during normal engine operation as the vane-angle of IGV 34 and vane 48 are adjusted. In order to reduce the bending moment of IGV 34 during operation, and in particular during surge events, IGV 34 is restrained at its inner diameter end with inner air seal surge retaining mechanism 36.

Inner air seal surge retaining mechanism 36 provides a means for restraining axial movement of the inner diameter end of IGV 34 in the downstream or aft direction. Retaining mechanism 36 includes surge retainer 62 and carrier 64. Inner air seal carrier 64 includes leading and trailing edge bent-flanges that slide into corresponding grooves on the leading and trailing edges of shrouds 60, while surge retainer 62 comprises a spring-like member secured to intermediate case 28. Surge retainer 62 engages carrier 64 to restrain downstream movement of the inner diameter end of IGV 34. However, surge retainer 62 engages with carrier 64 so as to also permit sealing of the flow path along which primary air AP flows.

In order to increase the efficiency of HPC 18, blade 46 is sealed at its inner and outer diameter ends. Blade 46 includes rotatable sealing elements 66 and 68 for engaging with stationary sealing elements 70 and 72 of IGV 34 and vane 48, respectively. Aft duct 30 also includes stationary sealing element 74 for engaging with the outer diameter end of blade 48. Blade 46 rotates between IGV 34 and vane 48 at high speeds, while IGV 34, vane 48 and aft duct 30 remain stationary. In order to improve compression ratios of HPC 18 and to reduce the overall size of HPC 18, it is desirable to reduce the distance between blade 46 and the stationary components surrounding it, while also preventing undesirable contact. Accordingly, aft duct 30 includes sealing element 74, which comprises an abradable or sacrificial material such as honeycomb, that will yield upon contact of a rotating blade 46. Thus, the outer diameter end of blade 46 can be held in close proximity with aft duct 30 to prevent leakage of primary air $A_P$ around the tip of blade 46 without much risk of interference. Likewise, the inner diameter end of blade 46 is sealed by bringing rotating sealing elements into close proximity with stationary sealing elements 70 and 72, respectively. Stationary sealing elements 70 and 72 also comprise abradable or sacrificial material such as honeycomb such that contact with rotating sealing element 66 or 68 is sustainable. Rotating sealing elements 66 and 68 comprise knife-edge surface or the like that upon rotational contact with stationary sealing elements 70 and 72 cut into or wear away the abradable honeycomb material. Thus, sealing elements 66 and 68 can be brought into close contact with sealing elements 70 and 72 to prevent escape of primary air $A_P$ into the interior of engine 10. Carrier 64 and stationary sealing member 70 of inner air seal surge retaining mechanism 36 thus permit the inner diameter end of IGV 34 to be stabilized to prevent damage caused by bending, yet also permit the inner diameter end of blade 46 to be sealed in a compact manner. Both retainer 62 and rotating seal member 66 engage carrier 64 from the innermost radial extent, or bottom, of carrier 64 such that blade 64 is brought into close proximity to IGV 34 to reduce the size of cavity C.

Figure 3:
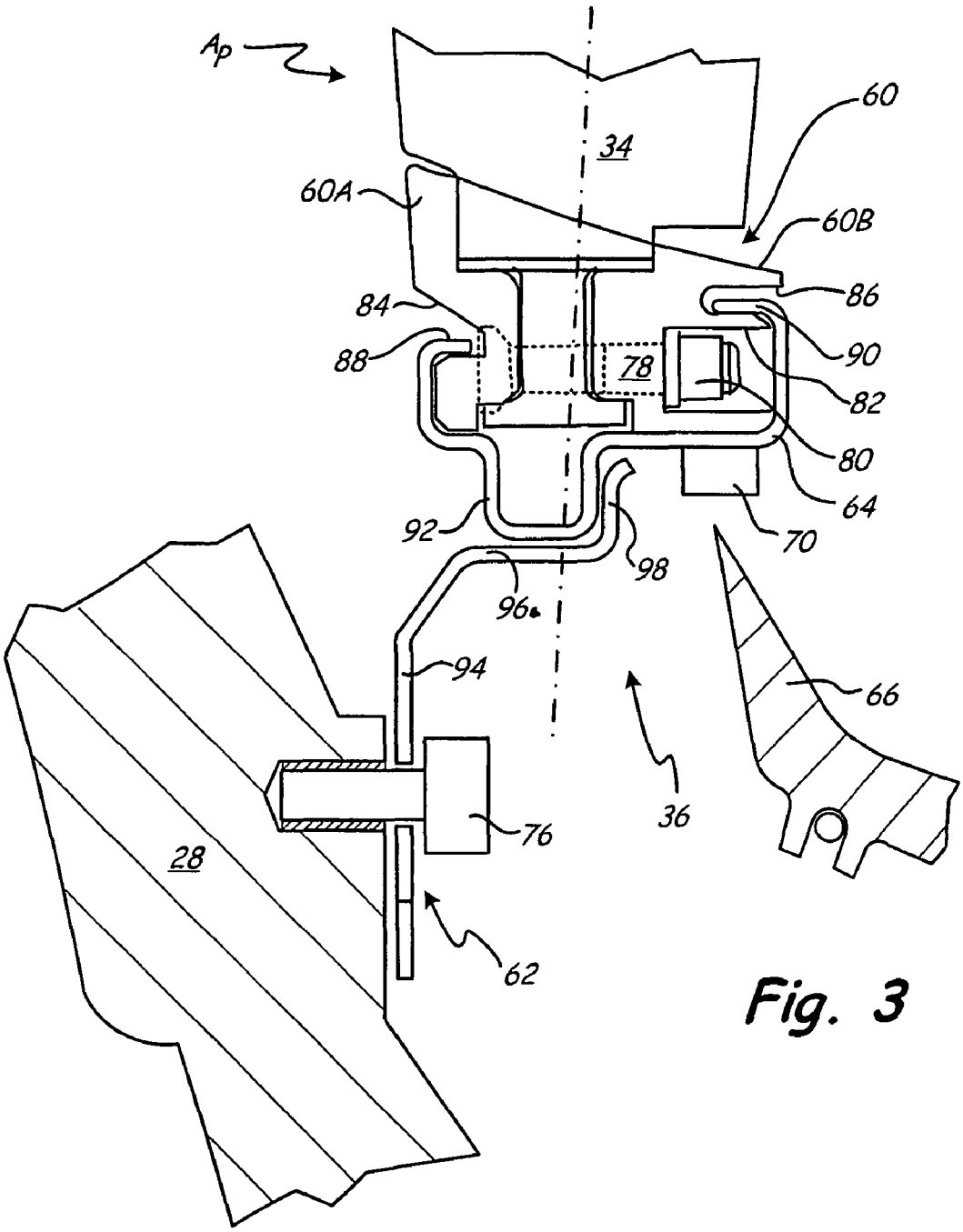
FIG. 3 shows an inlet guide vane inner air seal surge retaining mechanism of the present invention.

FIG. 3 shows inlet guide vane inner air seal surge retaining mechanism 36 restraining the inner diameter end of inlet guide vane 34. Retaining mechanism 36 includes split-ring inner diameter shroud 60, surge retainer 62, carrier 64, stationary sealing member 70, mounting bolt 76, shroud bolt 78 and shroud nut 80. IGV 34 is suspended from HPC aft duct 30 (FIG. 2) such that the inner diameter of IGV 34 is suspended within the flow path of primary air $A_P$. Inner diameter trunnion 58 of IGV 34 is secured within split-ring inner diameter shroud 60, which comprises forward shroud 60A and aft shroud 60B such that they can be secured to each half of aft duct 30. Shroud bolt 78 and shroud nut 80 clamp forward shroud 60A and aft shroud 60B around inner diameter trunnion 58 such that the inner diameter end of IGV 34 is held in a fixed relationship to other IGVs of engine 10 within the air flow path. Carrier 64 is clamped around shroud 60 to prevent nut 80 from backing off of bolt 78. Carrier 64 comprises a thin, sheet metal clip that can be deformed to fit around forward shroud 60A and aft shroud 60B to prevent nut 80 from disengaging bolt 78. Aft shroud 60B includes pocket 82 that permits nut 80 to be recessed within aft shroud 60B allowing carrier 64 to easily fit around shroud 60. Forward shroud 60A includes notch 84 and aft shroud 60B includes notch 86 that engage with flanges 88 and 90, respectively, of carrier 64 to prevent carrier 64 from disengaging shroud 60 in the radial direction. Flange 88 abuts the leading edge of bolt 78 within notch 84, while flange 90 engages notch 86 above nut 80. Carrier 64 also includes jog 92 for engaging with surge retainer 62, and stationary seal member 70 for engaging with rotating seal member 66. Jog 92 is positioned on the forward portion of carrier 64, while seal member 70 is positioned on an aft portion of carrier 64. Surge retainer 62 is thus permitted to engage carrier 64 between jog 92 and seal member 70.

Surge retainer 62 is secured to intermediate duct 28 with a circular pattern of bolts 76, or some other such fastener. Surge retainer 62 includes radial extension arm 94, axial extension arm 96 and axial retention hook 98. Radial extension arm 94 comprises an elongate extension that permits retainer 62 to extend radially from the connection at bolt 62 to carrier 64. Axial extension arm 96 permits retainer 62 to extend axially from intermediate case 28 to carrier 64. Axial retention hook 98 extends radially from axial extension arm 96 to engage with jog 92 to prevent axial movement of the inner diameter end of IGV 34. Surge retainer 62 is comprised of a continuous circular structure such that it abuts intermediate case 28 continuously around engine centerline CL. However, in other embodiments, retainer 62 may comprise a split-ring configuration, or may comprise a crenellated or scalloped structure for weight reduction.

Axial extension arm 96 and axial retention hook 98 are shaped to match the profile of jog 92. In the embodiment shown, jog 92 comprises a rectangular-like projection or corrugation in carrier 64, and axial retention hook 98 comprises a similarly shaped flange. However, in other embodiments jog 92 can have other shapes. In still other embodiments, jog 92 comprises a projection, protrusion or other such outcropping attached to carrier 64. In any embodiment, axial retention hook 98 engages a downstream or aft facing portion of jog 96 to prevent movement of IGV 34 in the downstream direction. Retainer 62 is also configured to prevent forward or upstream movement of IGV 34. Radial extension arm 94 and axial extension arm 96 are shaped and configured such that they provide a spring-like biasing force against jog 92 after assembly of inlet guide vane inner air seal surge retaining mechanism 36. For example, radial extension arm 94 lays flush with intermediate case 28 such that intermediate case 28 provides bending resistance to and stiffens retainer 62. Thus, the force of axial extension arm 96 against jog 92 prevents forward movement of IGV 34 and, in other embodiments can be used to pin carrier 64 against intermediate duct 28. Thus, in the various embodiments, retainer 96 is not rigidly affixed to carrier 64 such that IGV 34 is not rigidly restrained, but is permitted some degree of movement in the axial direction.

Additionally, axial retention hook 98 engages jog 92 without interfering with rotating seal member 66 of blade 48. Stationary seal member 70 is placed on carrier 64 away from jog 92 to permit axial retention hook 98 to access carrier 64 between jog 92 and seal member 70. Seal member 70 is placed toward the trailing edge of carrier 64 such that seal member 66 does not need to extend far beyond blade 48. Seal member 70 is also wide enough such that any small movements of IGV 34 due to surge or other engine events do not disrupt the seal between seal member 70 and seal member 66. Additionally, carrier 64 and seal member 70 do not extend beyond the trailing edge of IGV 34 such that blade 48 can be brought into close proximity to IGV 34, thus reducing the cavity size C between IGV 34 and first-stage blade 48. Specifically, seal member 70 and jog 92 are positioned underneath IGV 34 on the innermost diameter surface of carrier 64. In the embodiment shown, stationary seal member 70 and rotating seal member 66 comprise a knife-edge seal/honeycomb material interface. However, in other embodiments, other sealing arrangements such as brush seals may be used. In still other embodiments, stationary seal member 70 can be configured as a knife-edge seal, and rotational seal member 66 can be configured as an abradable material.

Inlet guide vane inner air seal surge retaining mechanism 36 provides a lightweight and inexpensive means for securing the inner diameter end of IGV 34 in a sealed manner. Surge retainer 62 and carrier 64 comprise thin, sheet metal structures making the raw materials necessary for construction inexpensive and easily repairable or replaceable. In other embodiments, surge retainer 62 and carrier 64 are machined from a ring structure. Additionally, retainer 62 and carrier 64 are easily manufactured in that the sheet metal is readily shaped or bended to form the components. Furthermore, seal member 70 is readily brazed to carrier 64.

Although the present invention has been described with reference to preferred embodiments, workers skilled in the art will recognize that changes may be made in form and detail without departing from the spirit and scope of the invention.

The invention claimed is:

1. A retaining mechanism for an inlet guide vane disposed between an intermediate case and a compressor rotor in a gas turbine engine, the retaining mechanism comprising:

an inner air seal carrier comprising a body for securing to an inner diameter end of the inlet guide vane;

a protrusion positioned on a radially inward face of the inner air seal carrier;

a surge retainer having:

a first end connected to the intermediate case; and a second end engaged with the protrusion for stabilizing the inner diameter end of the inlet guide vane; and a stationary sealing element disposed on the radially inward face of the inner air seal carrier aft of the protrusion and for engaging with a rotatable sealing element of the compressor rotor.

2. The retaining mechanism of claim 1 wherein the retaining mechanism further includes a split-ring shroud fastened to the inner diameter end of the inlet guide vane by a threaded fastener.

3. The retaining mechanism of claim 2 wherein the inner air seal carrier clamps around the split shroud to prevent disengagement of the threaded fastener from the split-ring shroud.

4. The retaining mechanism of claim 1 wherein the inner air seal carrier comprises a sheet metal structure and the protrusion comprises a jog in the sheet metal.

5. The retaining mechanism of claim 1 wherein the second end of the surge retainer includes a hook portion having a shape matching that of the protrusion.

6. The retaining mechanism of claim 5 wherein the hook portion engages the body between the protrusion and the stationary sealing element.

7. The retaining mechanism of claim 1 wherein the surge retainer further comprises:

an axial retention hook at the first end;

a radial extension arm at the second end; and an axial extension arm between the radial extension arm and the axial retention hook.

8. The retaining mechanism of claim 1 wherein the stationary sealing element comprises a material abradable by knife-edge.

9. The retaining mechanism of claim 1 wherein the outer diameter end of the inlet guide vane is secured to a compressor case such that the inlet guide vane is cantilevered between the intermediate case and the compressor rotor.

10. The inner air seal carrier of claim 9 wherein the stationary sealing element comprises a sacrificial seal material.

11. An inner air seal carrier for use in a gas turbine engine having an inlet guide vane surge retainer, the inner air seal carrier comprising:

a body for securing around an inlet guide vane inner diameter shroud;

a stationary sealing element disposed on a radially inward face of the body for engaging with a rotatable sealing element of a compressor rotor; and an outcropping on the radially inward face of the body disposed forward of the stationary sealing element and for engaging with the surge retainer.

12. The inner air seal carrier of claim 11 wherein the body is shaped to fit around a split shroud fastened to an inner diameter end of the inlet guide vane by a threaded fastener to prevent disengagement of the threaded fastener from the split shroud.

13. The inner air seal carrier of claim 11 wherein the body comprises a sheet metal structure and the outcropping comprises a jog in the sheet metal.

14. The inner air seal carrier of claim 11 wherein the outcropping comprises a polygonal corrugation in the body.

15. A retention system for inlet guide vanes disposed between a fan case and a compressor case in a gas turbine engine, the system comprising:

an array of inlet guide vanes, each vane comprising:

an outer diameter trunnion secured to the compressor case; and an inner diameter trunnion radially cantilevered within the compressor case;

an inner diameter shroud secured to the inner diameter trunnions of the array of inlet guide vanes for maintaining circumferential spacing of the array of inlet guide vanes;

an inner air seal carrier mounted to the inner diameter shroud, the inner air seal carrier comprising:

a stationary sealing element disposed on the body for engaging with a rotatable sealing element of a compressor rotor; and a jog disposed on a radially inner surface of the inner air seal carrier; and a surge retainer having:

a first end connected to the fan case; and a second end engaged with the jog for stabilizing the inner diameter shroud in the axial direction.

16. The retention system of claim 15 wherein the inner diameter shroud comprises a split ring secured to the inner diameter trunnions by threaded fasteners.

17. The retention system of claim 16 wherein the inner air seal carrier clamps around the split ring and the threaded fasteners.

18. The retention system of claim 15 wherein the inner air seal carrier comprises a sheet metal structure and the jog comprises a corrugation in the sheet metal.

19. The retention system of claim 15 wherein the inner air seal carrier includes a retention portion having a shape matching that of the jog.

20. The retention system of claim 19 wherein the retention portion engages the inner air seal carrier between the jog and the stationary sealing element.

21. The retention system of claim 19 wherein the jog has a polygon-like shape.

22. The retention system of claim 15 wherein the jog is disposed on the inner air seal carrier forward of the stationary sealing element.

* * * * *